United States Patent [19]

Kearns et al.

[11] 4,349,398

[45] Sep. 14, 1982

[54] PROTECTIVE COATING SYSTEM

[75] Inventors: Richard F. Kearns, Broken Arrow; Thomas R. Kearns; Timothy P. Kearns, both of Norman, all of Okla.

[73] Assignee: Edward C. Kearns, St. Petersberg, Fla.

[21] Appl. No.: 214,122

[22] Filed: Dec. 8, 1980

[51] Int. Cl.[3] ..... E04B 7/00

[52] U.S. Cl. ..... 156/71; 156/94; 156/280; 428/255; 428/63; 428/309.9; 427/140; 427/403; 52/309.12; 264/34; 264/255; 264/333; 428/312.4; 428/317.7

[58] Field of Search ..... E04B/1/00; 156/91, 94, 156/71, 303.1, 280; 428/247, 255, 256, 310, 703, 63, 140, 86; 264/DIG. 57, 309, 255, 256, 257, 259, 333, 121, 171, 174, 271.1, 34, 36; 52/720, 434, 309.12; 427/140, 403; 404/70

[56] References Cited

U.S. PATENT DOCUMENTS 3,110,981 11/1963 Larner ..... 52/177

4,168,924 9/1979 Draper et al. ..... 428/255

*Primary Examiner*—Edward C. Kimlin

*Assistant Examiner*—F. K. Wine

*Attorney, Agent, or Firm*—Arthur McIlroy

[57] ABSTRACT

Protective coating systems are reinforced by first laying a suitable mesh screen of plastic, metal or the equivalent on the surface to be protected. Thereafter, a thin layer of a coating composition, e.g., a latex cement, is poured over the mesh and allowed to set. In this operation the mesh is bonded by means of the coating composition to said surface. The screen also protrudes to the upper surface of said layer and when the latter has been allowed to set, a second layer is applied resulting in a system in which the reinforcing mesh not only aids in forming a durable bond between said first layer and said surface, but also likewise renders the two layers thus formed resistant to spalling or separating caused from expansion or contraction of said surface.

8 Claims, 7 Drawing Figures

PROTECTIVE COATING SYSTEM

The present invention relates to a method of forming a reinforced coating for continuous surfaces such as roofs, concrete walls, sidewalks, driveways, ship decks and the like. More particularly, it pertains to a method of placing the reinforcing material between layers of coating composition and to the resulting system.

Roofing systems currently available suffer from a number of disadvantages such as their inability to withstand wide changes in structural stress due to temperature variations, etc. Normally, elastomeric, tar and silicone-based coatings, when they exceed their expansion limitations, tends to pick up a thin upper layer of the supporting structure. Repeated occurrences of this eventually cause the roof membrane (supporting structure) to deteriorate.

In the case of cracked or spalled concrete surfaces, no satisfactory lasting methods of repair are known. Cracks are usually filled with tar or similar material which expands and contracts with changes in temperature allowing water to penetrate the patched area. Subsequent freezing and thawing result in further damage to the concrete surface.

Surfaces exposed to salt air and salt water spray, although generally effectively protected by use of lead-based paints or similar compositions, must be maintained in good condition. Such protection requires frequent painting, a relatively expensive maintenance procedure. A specific problem in this same environment is the adequate protection of the on-deck piping systems employed on ocean going vessels. Such piping is usually insulated with a foam plastic or similar material. To protect the latter from the destructive action of the sun, such insulation is generally covered with a stainless steel jacket. While this system prevents corrosion of the piping and deterioration of the insulation, it is costly.

SUMMARY OF THE INVENTION

The problems cited above in connection with satisfactory repair and maintenance of roof systems, concrete surfaces, ship decks and the like can be readily and economically overcome by the use of the present invention. This invention is concerned with a method of forming an outer protective waterproof layer over a continuous surface wherein said layer is resistant to thermal shock, cracking, separating or peeling, as a result of structural movement. The concept is applicable to roofs, the reconditioning of concrete surfaces such as sidewalks, driveways, walls, swimming pools, and tanker decks, as well as protection for the piping systems on oil tanker decks, etc. The aforesaid protective layer is formed by first laying down a screen or suitable mesh material on the surface to be protected. Thereafter, a readily flowable coating composition such as, for example, a latex cement, which will be described in further detail below, asphalt, silicone coating compositions and the like, is applied over the screen or mesh material. The density of the coating composition is such that the screen or mesh will in a relatively short time float to the top of the resulting layer. The latter is then allowed to set, which generally requires a period of at least about ten to twelve hours. In the setting operation, the mesh is bonded by means of the coating composition to the surface to be protected. Thereafter, a second layer of the aforesaid composition is applied to the first layer, resulting in a system in which the reinforcing mesh or screen is sandwiched between the two layers of coating. The protective coating thus prepared is highly resistant to thermal shock and cracking, separating, or peeling caused by weathering, or movement of the structure it protects. We have found that the same results cannot be obtained by applying to the mesh in one operation a layer of coating composition essentially equivalent in thickness to the two layers of coating composition employed as described above. The mesh floats to the top and as a result is able to impart little, if any, structural reinforcement to the protective layers.

BRIEF DESCRIPTION OF THE DRAWINGS

The drawings shown herein illustrate the best mode contemplated of carrying out the present invention in which the above features are disclosed in detail, as well as others which will be readily understood from the description of such illustrated embodiments.

IN THE DRAWINGS

FIGS. 1 through 4 are perspective cutaway views partly in section of a roof structure employing a preferred embodiment of the present invention utilizing a screen reinforcing material placed between applied layers of a cementatious coating composition overlying a suitable roofing membrane. These Figures illustrate the sequence of steps involved in the method of the present invention.

Figure 5:
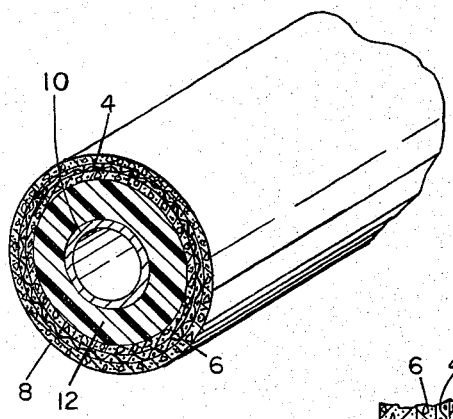

FIG. 5 is a perspective fragmentary view partly in section of an insulated pipe or conduit covered by reinforced dual layers of coating composition employed in the present invention. A similar application of the invention without the use of an insulating foam layer may be employed on ship and tanker decks to protect the latter from corrosion.

Figure 6:
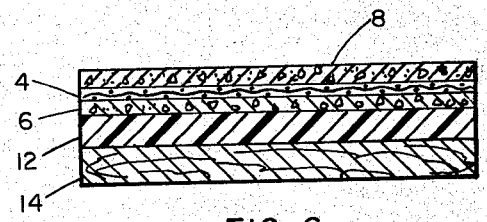

FIG. 6 is a sectional view of an insulated roof system in which a layer of plastic foam material rests on a wooden deck and the outer reinforced protective coating rests on the insulating material.

Figure 7:
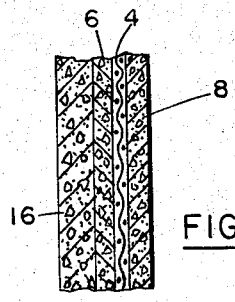

FIG. 7 is a sectional fragmentary view of a concrete surface protected from cracking or spalling by the mesh reinforced dual layered coating composition of the present invention.

Figure 1:
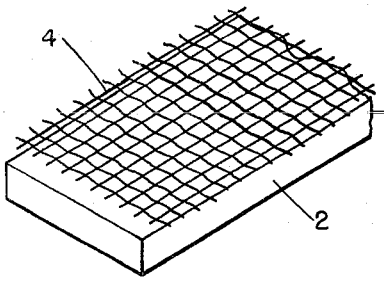
Figure 2:
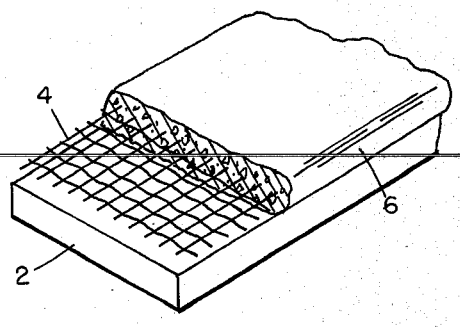

Referring now to the drawings, in FIG. 1 there is shown a roof deck or roof membrane 2 which may be of wood, polyurethane, steel, etc. Onto the insulation is placed a 10-mesh nylon or equivalent plastic screen 4. Over this is poured a thin layer of hydraulic cement 6 as shown in FIG. 2, modified with a minor amount of synthetic resin latex cement modifier and a fine aggregate. A suitable modified cement is prepared by mixing Portland cement, silica sand, powdered limestone, wetting agents and defoamers with a liquid acrylic aggregate additive containing enough water for a concrete mix.

Figure 3:
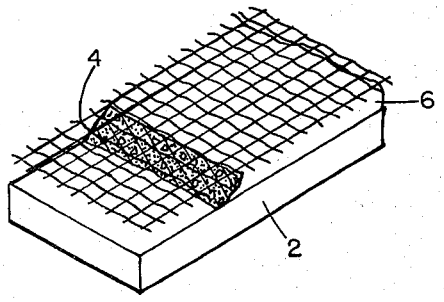
Figure 4:
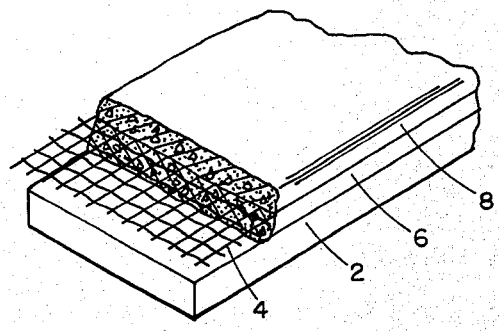

FIG. 3 illustrates reinforcing screen 4 after it has floated to the top of modified cement layer 6. The screen rises to the top of cement layer 6 prior to the time the latter dries which is usually two or three hours. After layer 6 is permitted to set, usually requiring a period of ten to twelve hours, a second layer of cement 8 of the same or similar composition as layer 6 is poured over screen 4, providing the structure illustrated in FIG. 4.

FIG. 5 shows still another application of the present invention to the protection of metal conduits exposed to widely varying atmospheric conditions. Thus, conduit 10 is surrounded with a layer of insulating foam 12.

Over said insulating layer is placed a loose-fitting, cylindrically-shaped screen 4, on top of which is distributed a first layer of modified cement 6. During the drying process, the screen floats to the surface of cement layer 6. After the latter is allowed to set, a second modified cement layer 8 is applied, resulting in reinforcing screen 4 beging sandwiched in between layers 6 and 8, thus providing a durable, protective coating for insulated pipe 10. This system can be readily modified to protect the decks of ships from salt spray and/or extreme weather conditions. In such applications, the insulating layer 12 may be omitted.

In FIG. 6, a roof structure is illustrated in which a wooden base or membrane 14 supports a layer of insulating polyurethane foam 12, which in turn is protected by dual layers of a latex cement layers 6 and 8 reinforced with nylon screen 4 which has been placed between said layers in accordance with the present invention.

FIG. 7 shows how application of the protective coating of the invention can be applied directly to concrete surfaces. In this case, a suitable screen is affixed to a vertical concrete wall 16 such as found in swimming pools, bridges, etc. A modified cement such as that described above is applied over screen 4 to form cement layer 6. In spite of the fact that the screen is in a vertical position, it floats or rises to the outside surface of layer 6. After the latter has properly set, layer 10 is formed thereon as previously described resulting in the protective structure shown.

DETAILED DESCRIPTION OF THE INVENTION

While a preferred embodiment of our invention is directed to the protection of wood, steel, or concrete surfaces by the use of reinforced dual layers of coating composition, the concept is applicable to any problem where a surface is subjected to cracking, rusting, peeling, separating, spalling, etc., resulting from weathering, thermal shock, or structural stress, or a combination of two or more of these conditions. Where the reinforced coating of our invention is used to protect an insulating layer, the latter may be of a number of synthetic or natural materials such as, for example, cork, kapok, etc. The synthetic organic insulating materials may be selected from several low density, lightweight, low heat transmission, substantially rigid foams. Without limitation on the generality of useful materials, the foam may be formed from a polyurethane resin, a vinyl resin such as polyvinyl chloride, copolymers of polyvinyl chloride and polyvinyl acetate, silicone resins, urea formaldehyde resins, polystyrene, synthetic rubber and the like.

While the reinforced dual protective layers may be of any of a number of materials, latex cements are generally preferred. The combined layers of latex cement pursuant to this invention may vary in thickness, usually from about ⅛ inch to about ¼ inch. Preferably, the coating composition we employ contains as its essential elements hydraulic cement and fine aggregate modified by the use of from about 5% to about 20% of a synthetic resin cement modifier to provide said composition with a high impact strength, as well as excellent resistance to weathering action, thermal stress, etc.

Preferred cement modifiers are aqueous acrylic emulsions such as described in "Acrylic Modifiers for Cement", Resin Review, Vol. 24, No. 2 (1974). A preferred cement composition, as contemplated by the present invention, contains from about 45% to 60% Portland cement by weight on a dry solids basis and about 5% to about 20% of the acrylic cement mortar modifier resin emulsion. "Rhoplex E-330" (about 45% solids) described in brochure "Rhoplex E-30 Cement Mortar Modifiers", Rohm and Haas, August 1974, or "Rhoplex MC-76" (about 47% solids). Other concrete coating compositions may be obtained by using other commercial latex cement modifiers such as, for example, butydiene-styrene, vinylidine chloride or polyvinyl acetate.

Preferred aggregates are fine silica sand within the size range of from about 20 to about 100 microns, finely divided calcium carbonate of a size range from about 2 to about 20 microns, and quartz flour having a particle size of from about 10 to 100 microns.

The reinforcing mesh employed may be of a plastic or metal having typically from about 5 to about 15 holes per linear inch, such as, for example, 5- to 10-mesh. Number 10-mesh, i.e., 100 squares per square inch, resin coated nylon screen is generally preferred owing to its elastic capabilities. Reinforcing mesh or screen made of nylon imparts greater flexural strength to the protective coating and when placed between layers of said coating in accordance with the present invention markedly improves the resistance to damage of the protective coating resulting from weathering, structural stress, peeling, etc. Also when said layers are subjected to stress, the elastic mesh tends to bring the protective layers back to their original dimensions. The reinforcing screen may be made of materials other than nylon such as, for example, polypropylene, polyethylene, steel, aluminum, etc.

In carrying out our invention, the screen or mesh described above is first placed over the surface to be protected. Thereafter, a modified cement as described above, or other coating composition previously referred to, is placed over the screen in a layer, for example, from about 1/16 to about ⅛ inch in thickness. This layer may be applied by brushing, spraying, or spread on with a trowel. While the cement is drying, the screen floats to the surface thereof. The drying time of the cement layer is usually two to three hours and the setting time about ten to twelve hours. The modified cement reaches about 90% of its ultimate strength in about 48 hours and cures after about seven days. The second layer of cement is applied after the first has set, e.g., in about twelve hours, and after an additional twelve hours, a protective coating system is formed with reinforcing screen between the two cement layers, thus forming an outer surface capable of substantially lengthening the life of the supporting structure it is designed to protect.

Where the aforesaid protective coating is used in roofing systems, it is placed over a suitable insulating layer, preferably of a rigid foam material of the type referred to above and described in FIG. 6.

It will be apparent to those skilled in this art that the method of our invention is applicable to a wide variety of problems involving the protection of structural surfaces. The application of our invention to such problems is considered to lie within the scope of the appended claims.

What is claimed is:

1. A method for applying an outer protective waterproof coating of latex cement to a continuous surface comprising first laying down a layer of screen over said surface, said screen having typically from about 5 to 15 holes per linear inch, next overlaying said screen with a readily flowable coating composition of said latex cement effective to cause said screen to float to the top of said coating, thereafter permitting said coating to form a set surface, thus bonding said screen and said set surface to said continuous surface, then applying a second layer of said coating material to said set surface and allowing said second layer to set whereby said layers are reinforced by means of said screen situated essentially between said layers, both of said layers in a set condition being from about 1/16 to about ¼ inch in thickness.

2. The method of claim 1 wherein said continuous surface is an insulating material selected from the group consisting of natural substances and synthetic organic polymers in the form of a substantially rigid foam.

3. The method of claim 2 wherein said insulating material is a polyurethane foam.

4. The method of claim 1 wherein said coating consists essentially of separate layers of a thin, hard concrete having high impact, flexural, and tensile strength, said concrete being made with hydraulic cement modified with a minor amount of a synthetic resin latex cement modifier and a fine aggregate.

5. The method of claim 1 wherein the reinforcing screen employed is a plastic screen.

6. The method of claim 5 wherein the screen employed is a nylon screen.

7. The method of claim 1 wherein the coating composition employed is a hydraulic cement modified with a synthetic resin latex cement and a fine aggregate.

8. The method of claim 3 wherein the screen employed is a nylon screen.

* * * * *